US006837763B1

(12) United States Patent
Masteller

(10) Patent No.: US 6,837,763 B1
(45) Date of Patent: Jan. 4, 2005

(54) ADJUSTABLE FIN POSITIONING SYSTEM

(76) Inventor: William T. Masteller, 30348 135th St., Selby, SD (US) 57472

( * ) Notice: Subject to any disclaimer, the term of this patent is extended or adjusted under 35 U.S.C. 154(b) by 0 days.

(21) Appl. No.: 10/638,167

(22) Filed: Aug. 8, 2003

(51) Int. Cl.[7] ..... B63B 1/00
(52) U.S. Cl. ..... 441/79
(58) Field of Search ..... 441/79; 114/140

(56) References Cited

U.S. PATENT DOCUMENTS

| | | | | |
|---|---|---|---|---|
| 2,521,212 A | | 9/1950 | Geisler | |
| 3,579,681 A | | 5/1971 | Pope III, et al. | |
| 3,585,663 A | | 6/1971 | Johnson | |
| 3,659,300 A | | 5/1972 | Johnson | |
| 3,965,514 A | | 6/1976 | Shafer et al. | |
| 4,044,416 A | | 8/1977 | Brewer et al. | |
| 4,421,492 A | | 12/1983 | Leva | |
| 4,493,665 A | | 1/1985 | Liddle | |
| 4,846,745 A | | 7/1989 | Lobe | |
| 4,850,917 A | | 7/1989 | Wilson et al. | |
| 5,215,488 A | * | 6/1993 | Bailey | 441/79 |
| 5,567,190 A | | 10/1996 | Oates | |
| 5,997,376 A | | 12/1999 | Block et al. | |
| 6,386,933 B1 | | 5/2002 | Rewald et al. | |

* cited by examiner

*Primary Examiner*—Ed Swinehart
(74) *Attorney, Agent, or Firm*—Leonard & Proehl, Prof. L.L.C.

(57) ABSTRACT

An adjustable fin insert assembly is disclosed for mounting on a cavity of a wake board, and includes a fin box positionable in the cavity of the board. The fin box is elongate and includes a longitudinal slot which extends into the fin box from a lower surface thereof. The assembly includes a fin member removably mountable on the fin box adjacent the slot with a portion of the fin member extending into and being slidable along the slot for permitting adjustment of a position of the fin member in the slot. The assembly also includes a plurality of positioning members positioned in the slot and being longitudinally slidable in the slot. A space is defined in the slot adjacent to at least one of the positioning members, and the space is repositionable in the slot by sliding the at least one of the positioning members.

20 Claims, 8 Drawing Sheets

ADJUSTABLE FIN POSITIONING SYSTEM

BACKGROUND OF THE INVENTION

1. Field of the Invention

The present invention relates to fin adjusting systems and more particularly pertains to a new adjustable fin positioning system for providing easy and secure adjustment of the position of a fin on a recreational board.

2. Description of the Prior Art

The use of systems for adjusting fin positions on recreational boards is known in the prior art. In fact, many different systems have been proposed for permitting the adjustment of the position of a fin (or similar structure) on a recreational board such as a surfboard, wake board, etc. These systems have many different ways of and structures for securing the fin in position, but it believed that the structures incorporated in these systems are more complex than is required, which not only increases the cost of producing these system, but also in many cases increases the time and effort required by the user to make adjustments to the position of the fin.

Since the user of such systems will want to make many of the adjustments "in the field" away from many tools, systems requiring the use of tools or other things that are not readily available at the beach or in a boat are less than practical. A further concern is that the systems be sufficiently robust and tough to withstand the rigors to which the boards are commonly exposed during use, yet not be so heavy or bulky that the nature of the board is changed. Still further, compatibility with parts used by existing systems is also desirable.

In these respects, the adjustable fin positioning system according to the present invention substantially departs from the conventional concepts and designs of the prior art, and in so doing provides an apparatus primarily developed for the purpose of providing easy and secure adjustment of the position of a fin on a recreational board.

SUMMARY OF THE INVENTION

In view of the foregoing disadvantages inherent in the known types of fin adjusting systems now present in the prior art, the present invention provides a new adjustable fin positioning system wherein the same can be utilized for easily and securely adjusting the position of a fin on a recreational board.

In one aspect of the invention, an adjustable fin insert assembly is disclosed for mounting on a cavity of a wake board. The adjustable fin insert assembly includes a fin box positionable in the cavity of the board. The fin box is elongate and includes a longitudinal slot which extends into the fin box from a lower surface thereof. The assembly includes a fin member removably mountable on the fin box adjacent the slot with a portion of the fin member extending into and being slidable along the slot for permitting adjustment of a position of the fin member in the slot. The assembly also includes a plurality of positioning members positioned in the slot and being longitudinally slidable in the slot. A space is defined in the slot adjacent to at least one of the positioning members, and the space is repositionable in the slot by sliding the at least one of the positioning members.

In another aspect of the invention, a wake board system is disclosed that includes a combination of a wake board and the adjustable fin insert assembly. The wake board has a cavity formed therein, and the adjustable fin insert assembly is mounted in the cavity. In one embodiment, a pair of the cavities is formed in the board and is laterally spaced on the board, and a pair of the adjustable fin insert assemblies is mounted in the pair of cavities.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to easily and quickly adjust the position of a fin member on a board on which the fin box is mounted, while the invention provides a positive securing of the position of the fin member by employing positioning members that occupy the portions of the slot in the fin box that are not adjacent to the fin member, so the positioning members help to prevent unintended shifting of the fin member in the slot during rough use by blocking such movement.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
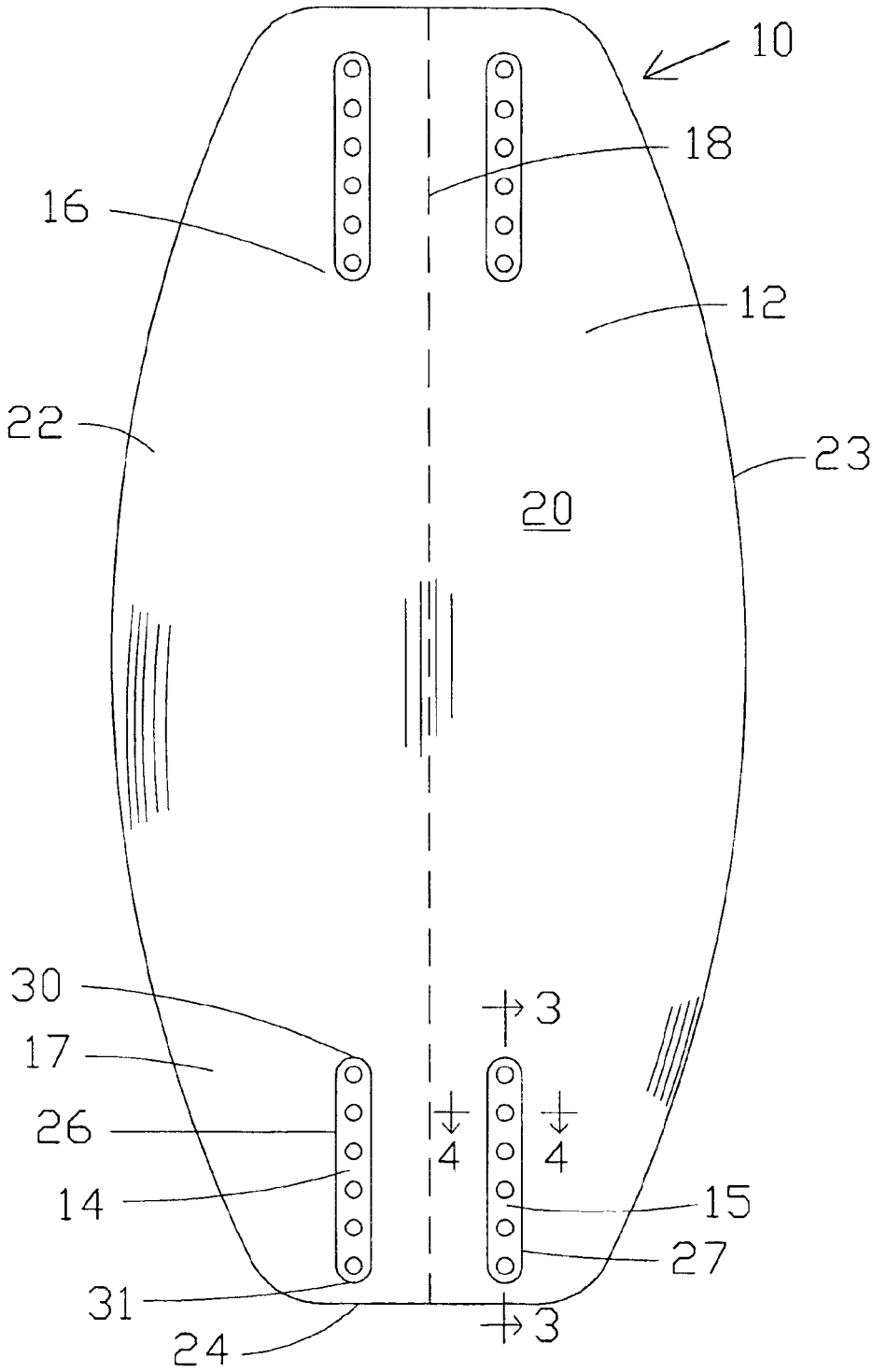
FIG. 1 is a schematic top view of a new adjustable fin positioning system according to the present invention.

With reference now to the drawings, and in particular to FIGS. 1 through 8 thereof, a new adjustable fin positioning system embodying the principles and concepts of the present invention and generally designated by the reference numeral 10 will be described.

Figure 2:
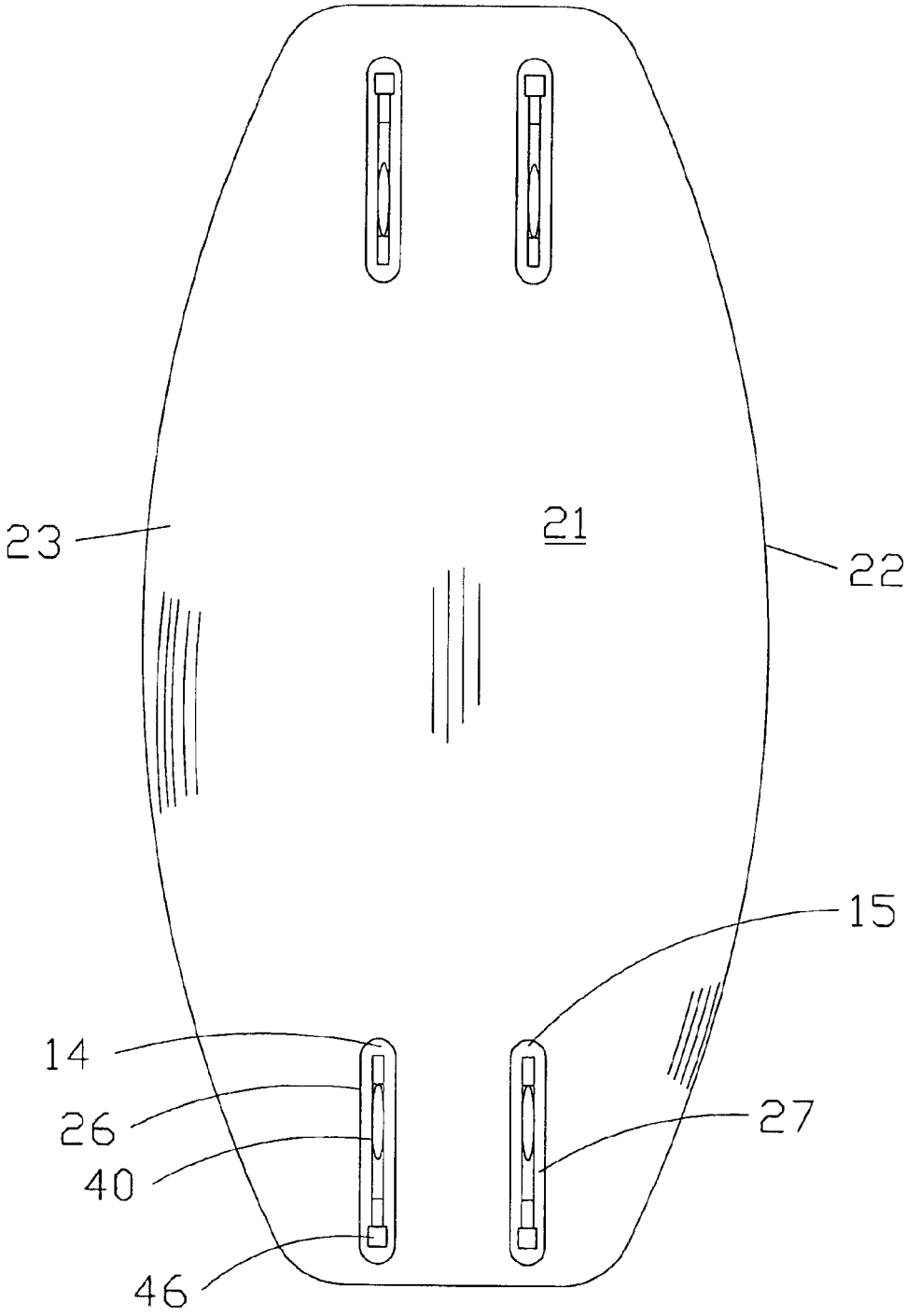
FIG. 2 is a schematic bottom view of the present invention.

The invention contemplates a wake board system 10 that comprises a wake board 12 and an adjustable fin insert assembly 14, or a pair of the adjustable fin insert assemblies 14, 15, mounted on the wake board 12 (see FIGS. 1 and 2). It should be appreciated that the adjustable fin insert assembly 14 may be produced and provided separately of the wake board 12, and that the fin insert assembly may be incorporated as an aftermarket accessory into preexisting wake boards. Further, it should be realized that the fin box assembly 14 described herein may be used on other types of water-riding items such as, for example, surfboards and water skis.

One suitable wake board 12 for the practice of the invention has a front portion 16, a rear portion 17, and has a longitudinal axis 18 that extends between the front and rear portions of the board. The board 12 has an upper surface 20 and a lower surface 21. The board 12 also may have a pair of lateral side edges 22, 23 and a rear edge 24. The board 12 has a cavity 26 formed therein, and for boards having a pair of the fin box assemblies, a pair of the cavities 26, 27 are provided in the board. The pair of cavities 26, 27 may be laterally spaced on the board 12, and may be oriented substantially parallel to each other. Further, fin box assemblies may be located at both ends of the board 12, as shown in FIG. 1.

The cavity 26 extends from the upper surface 20 to the lower surface 21 (see FIGS. 3 and 4), although in some embodiments of the invention it is possible that the cavity may extend from the lower surface 21 toward the upper surface 20 but may not actually extend through the upper surface 20. The cavity 26 may be elongated in a longitudinal direction of the board 12, and may be located in the rear portion 17 of the board. In one implementation of the cavity, the cavity 26 has a pair of substantially parallel sides 28, 29 and opposite ends 30, 31. In one implementation of the cavity 26, each of the opposite ends 30, 31 are semi-cylindrical in shape such that the cavity may be formed in the board 12 by the bit of a router or other similar tool.

A significant feature of the invention is the adjustable fin insert assembly 14, 15 mounted on the board 12. For ease and clarity of description, the features of the fin insert assembly 14 will be described with the understanding that fin insert assembly 15 (and any other fin insert assemblies employed) may be substantially identical. The adjustable fin insert assembly 14 is positioned in the cavity 26, and may be removable from the cavity, or may be more permanently mounted in the cavity such that the insert assembly is not easily removable.

Figure 3:
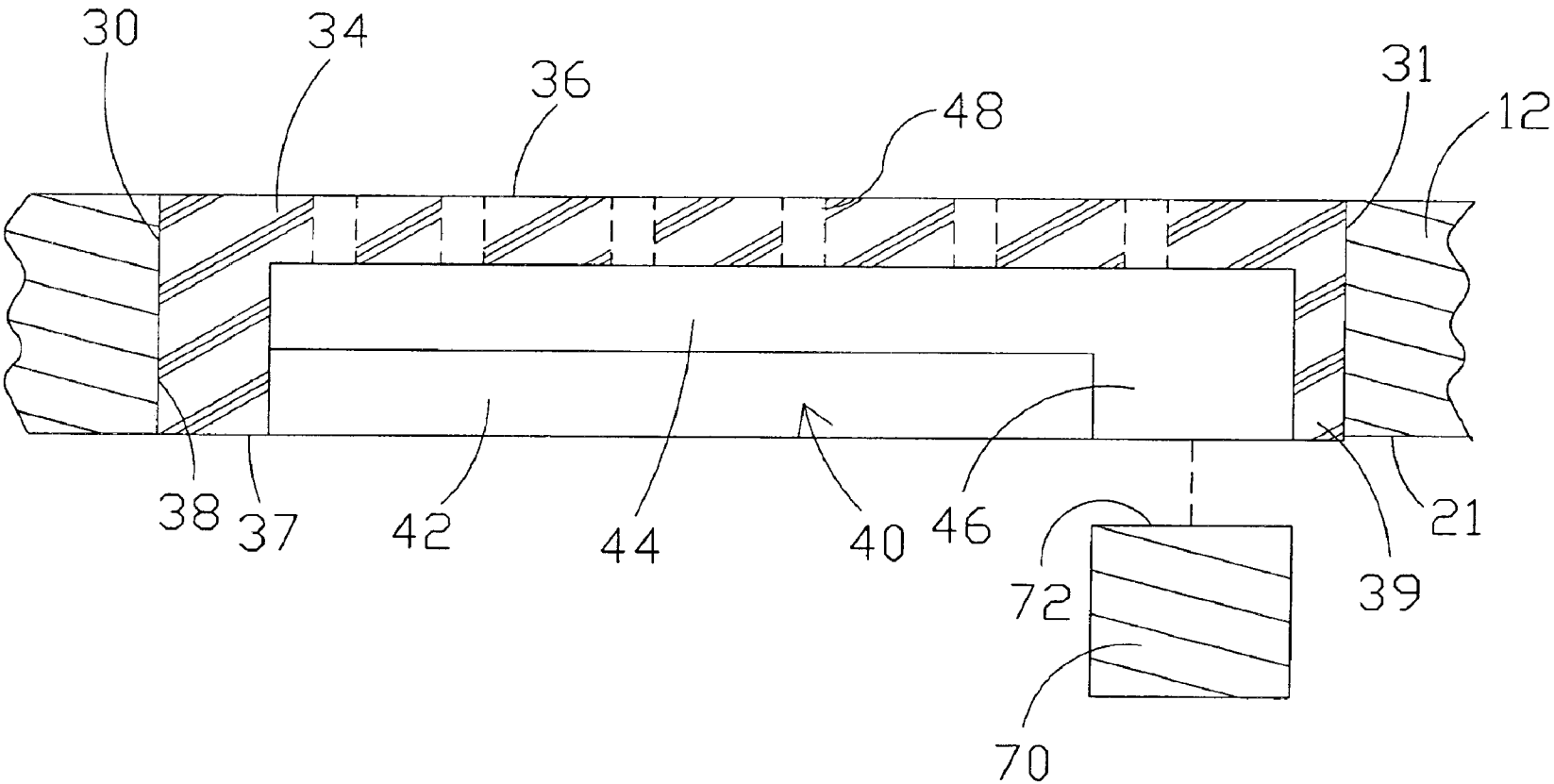
FIG. 3 is a schematic sectional view of the present invention taken along line 3—3 of FIG. 1.
Figure 4:
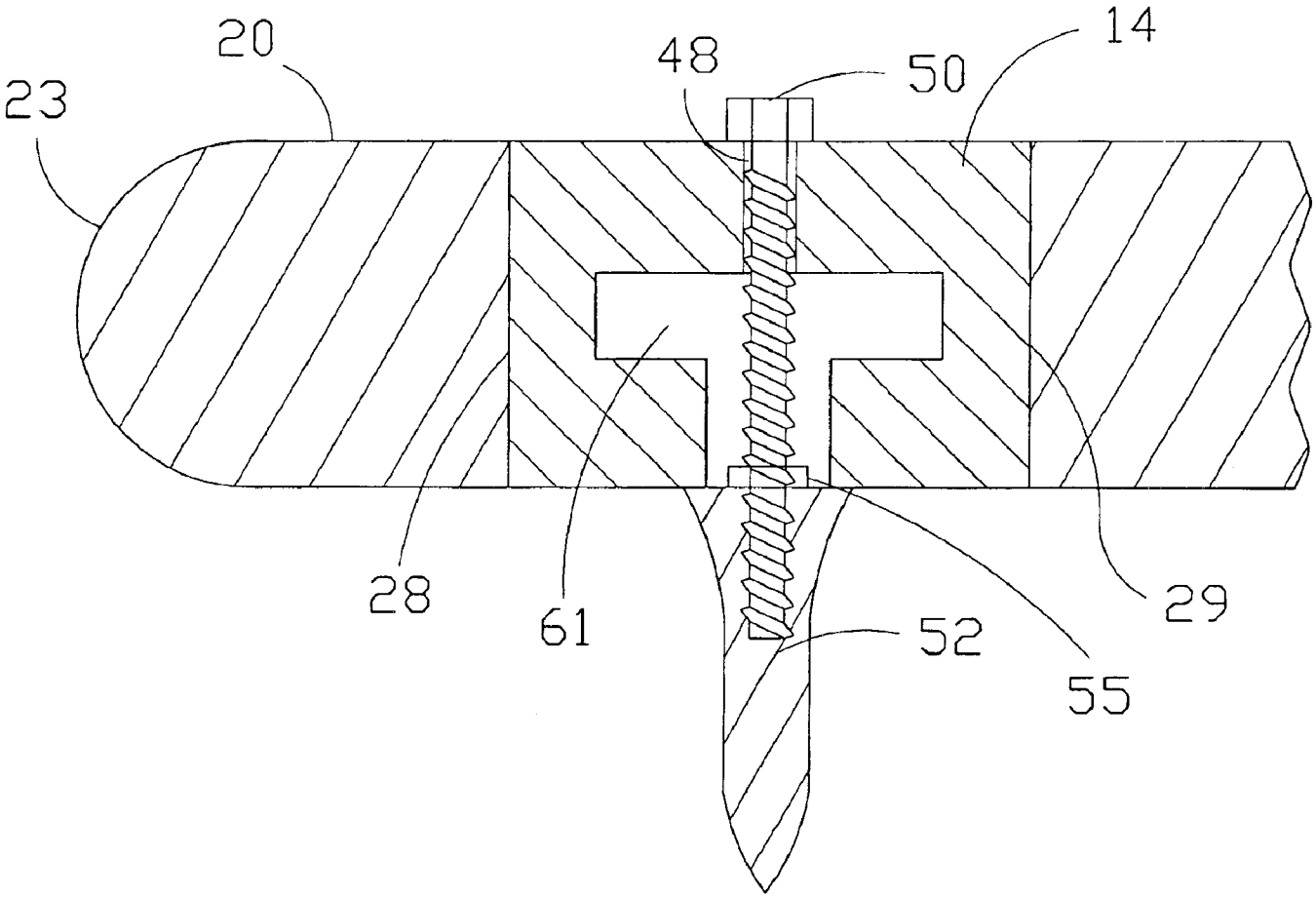
FIG. 4 is a schematic sectional view of the present invention taken along line 4—4 of FIG. 1.

The adjustable fin insert assembly 14 includes a fin box 34 that is positionable in the cavity 26 of the board 12 (see FIGS. 3 and 4). The fin box 34 may have an upper surface 36 and a lower surface 37. The fin box 34 may be elongate with a front end 38 and a rear end 39. The fin box 34 may have an outer perimeter that substantially corresponds in shape and size to an inner perimeter of the cavity 26 in the board 12 to permit a snug fit therebetween when the fin box is positioned in the cavity.

The fin box 34 may include a slot 40 that is formed in the fin box, and the slot 40 may extend into the fin box 34 from the lower surface 37 thereof. The slot 40 may extend along a longitudinal extent of the fin box 34. The slot 40 may comprise an entry portion 42 and a retaining portion 44. The entry portion 42 of the slot 40 may be in communication with the lower surface 37 of the fin box 34, and may extend in a plane that is oriented substantially perpendicular to the lower surface 37 of the fin box 34. The retaining portion 44 may be in communication with the entry portion 42 of the slot, and may extend in a plane oriented substantially perpendicular to the plane of the entry portion 42. Significantly, the entry portion 42 of the slot 40 is narrower in width than the retaining portion 44 of the slot, and the depth of the entry portion 42 may also be deeper than the retaining portion 44 of the slot.

The fin box 34 may further include a loading/unloading opening 46 formed in the fin box 34 (see FIG. 3). The loading/unloading opening 46 is in communication with the slot 40, and in some embodiments of the invention is located toward an end of the slot 40. The loading/unloading opening 46 preferably has a width that is substantially the same as the width of the retaining portion 44 of the slot 40, so that the positioning members (described below) may be mounted on the slot through the loading/unloading opening 46 when the fin box assembly is assembled.

Optionally, a plurality of securing holes 48 may be formed in the fin box 34 for receiving fasteners or other structures (see FIGS. 3 and 4). Each of the securing holes 48 may extend into the fin box from the upper surface 36 thereof. The securing holes 48 are in communication with the slot 40. The securing holes 48 may be distributed along a length of the slot, and may be substantially uniformly spaced with respect to each other. In one embodiment of the invention, fasteners 50 (such as, for example, screws) may be removably positioned in the one or more of the securing holes 48 for extending into the slot 40.

Figure 5:
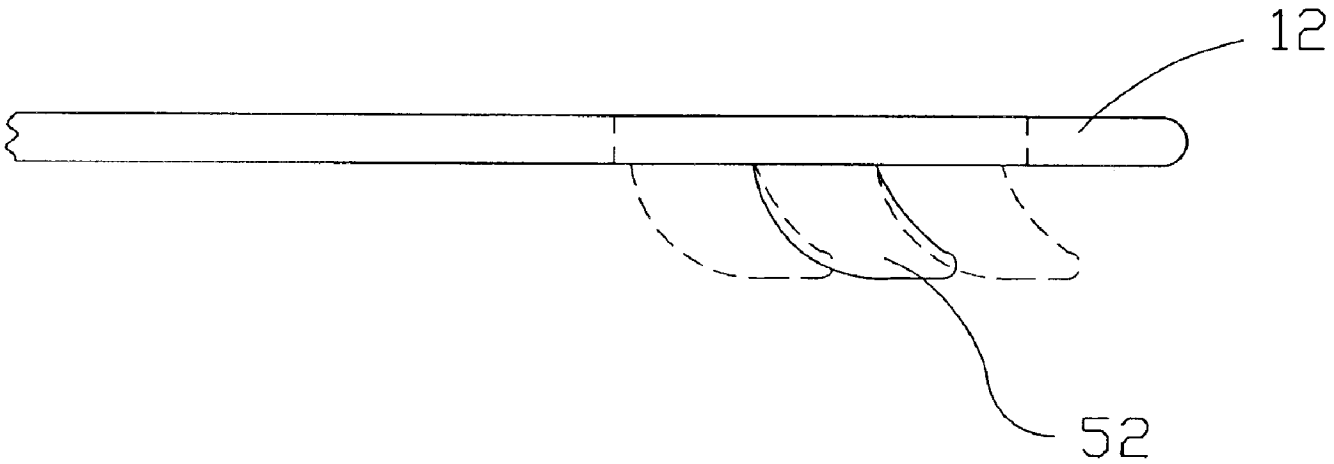
FIG. 5 is a schematic side view of the present invention showing the fin member in a relatively central position in the fin box, and showing the fin member in relatively forward and rearward positions in broken lines.
Figure 6:
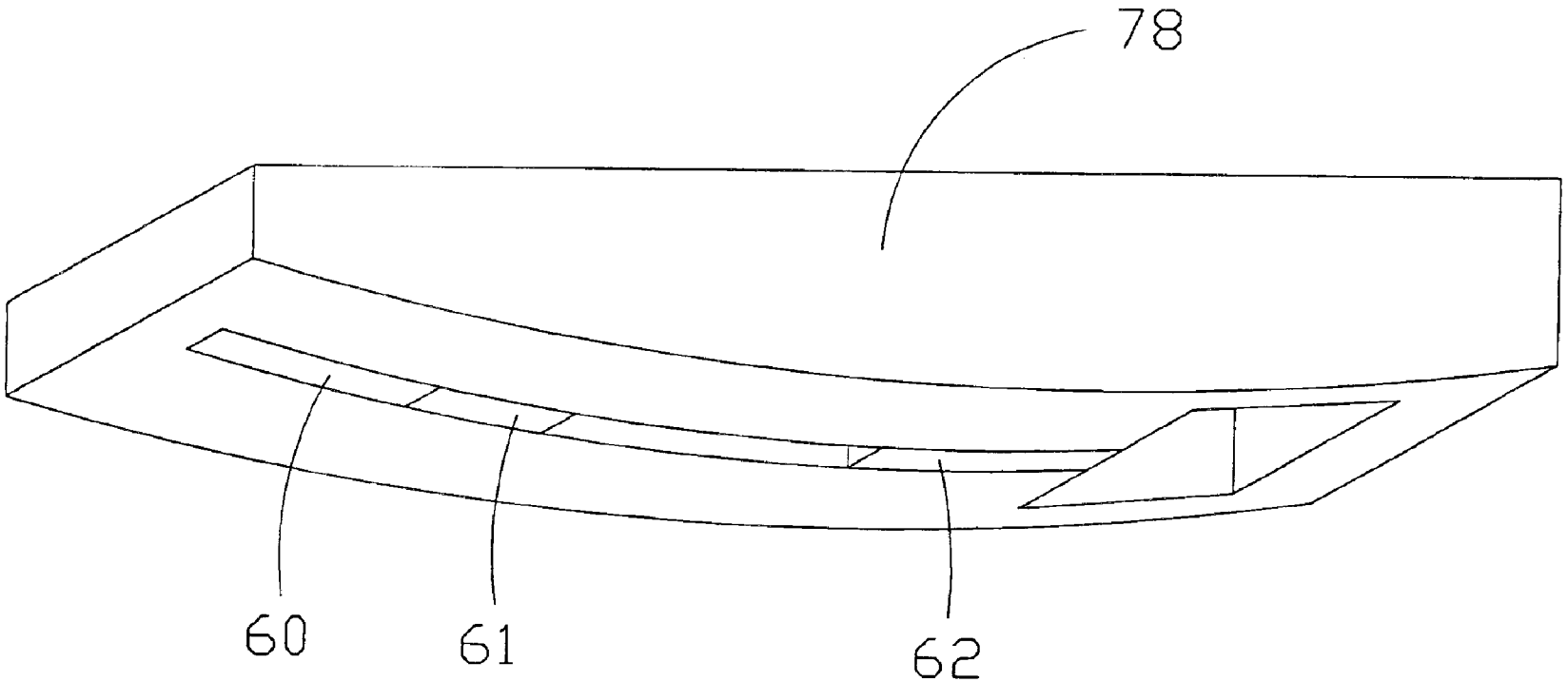
FIG. 6 is a schematic bottom perspective view of a fin box of the present invention that is optionally removable from the board to permit repositioning of the fin and positioning members in the slot.
Figure 7:
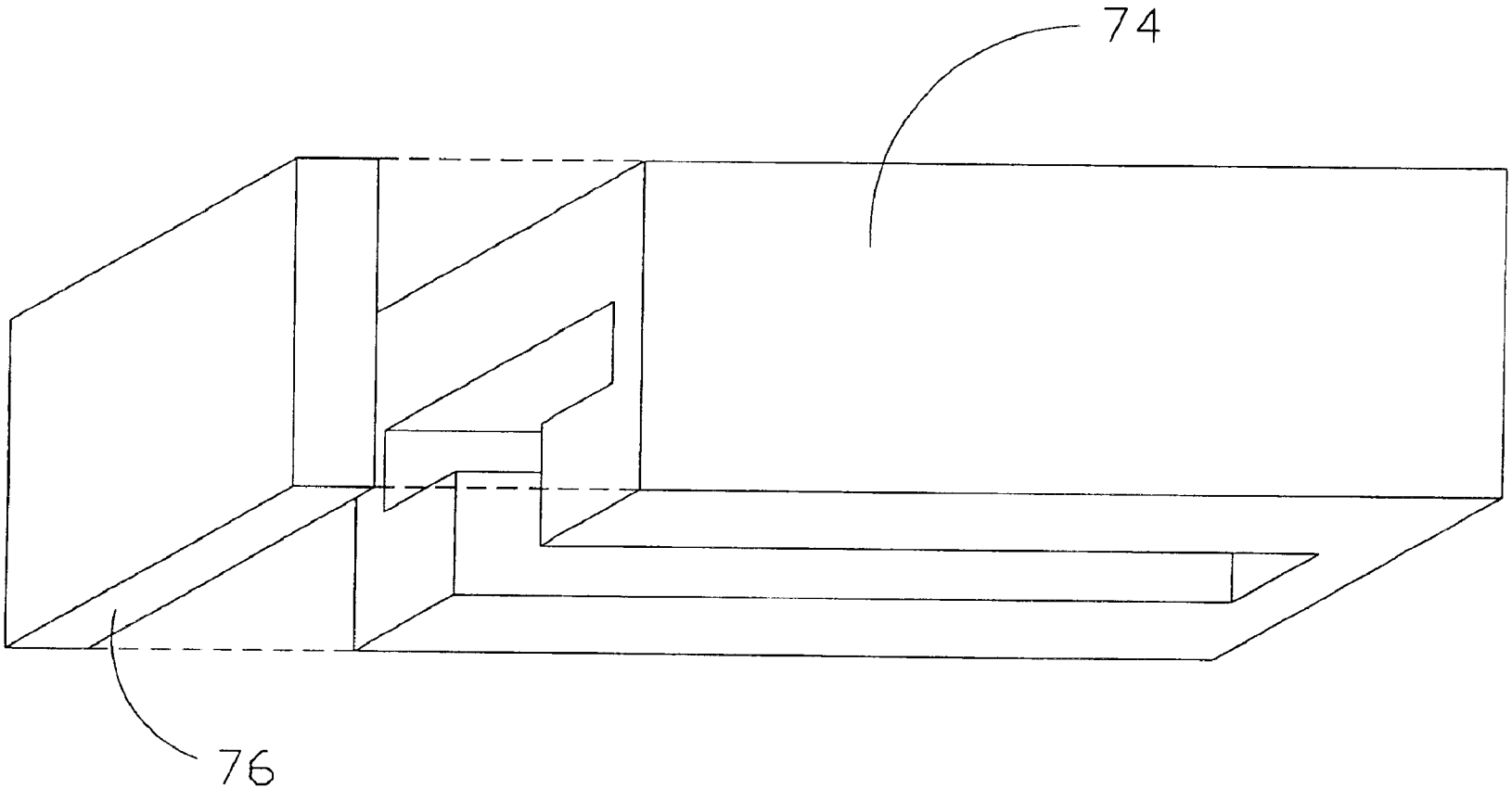
FIG. 7 is a schematic bottom perspective view of a fin box of the present invention having an optional contoured lowered surface.
Figure 8:
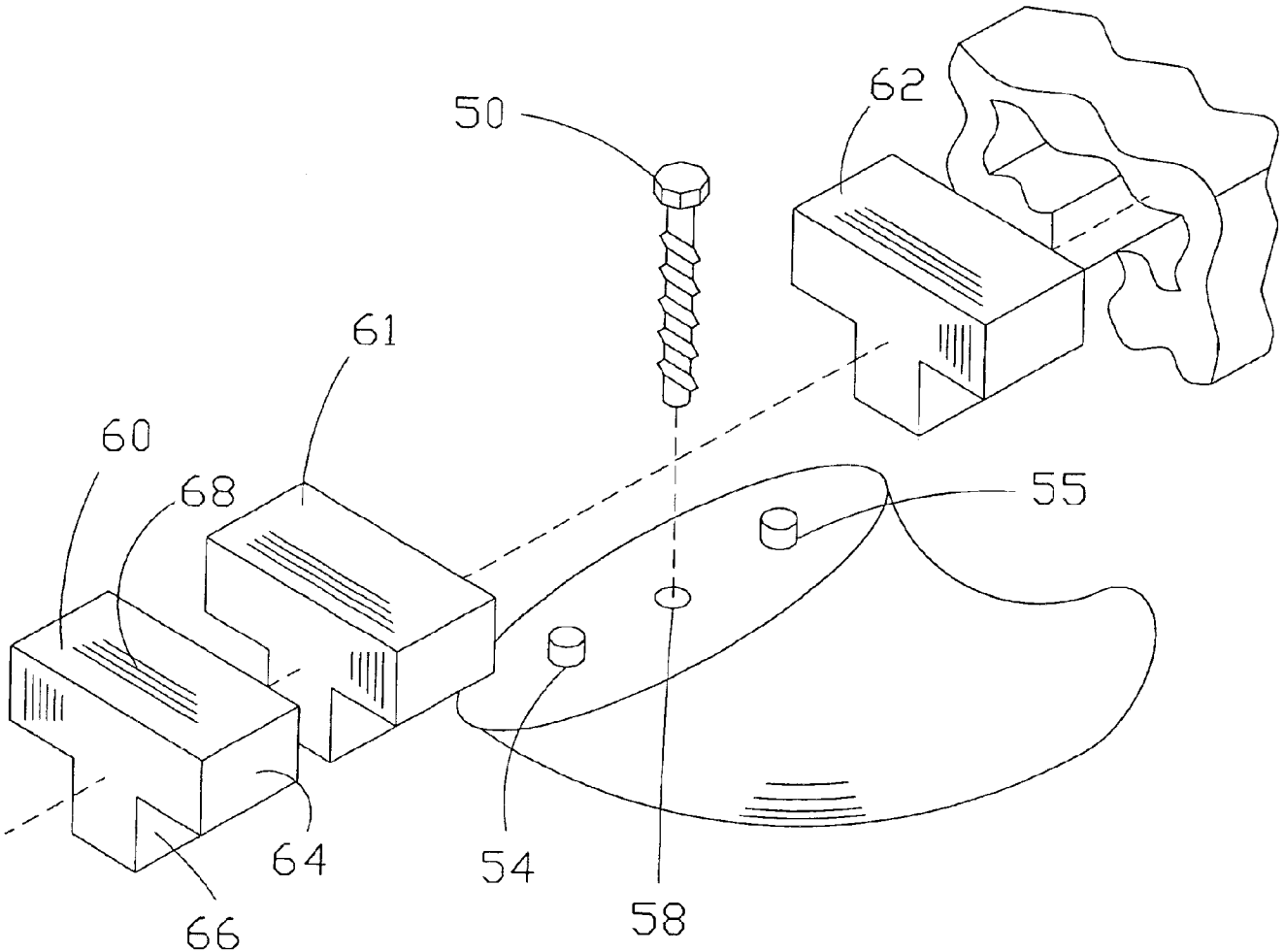
FIG. 8 is a schematic exploded view of the fin member and positioning members in exploded relation to slot of the fin box. Although shown in relation to the configuration of the fin box of FIG. 6, the relationship is similar to that of the fin box shown in FIG. 3 and FIG. 7.

The invention also contemplates a fin member 52 that is removably mountable on the slot 40 (see FIGS. 4, 5, and 8). The fin member 52 may be slid in the slot 40 for permitting adjustment of a position of the fin member in the slot and thereby permitting adjustable positioning of the location of the fin member on the board 12. In one embodiment, the fin member 52 includes a pair of protrusions 54, 55 extending from an upper edge of the fin member. The protrusions 54, 55 are positionable in the slot 40, and the slot may be sized to be just slightly wider that the lateral width of the protrusions so that lateral movement of the protrusions in the slot 40 is minimized. The fin member 52 may also have a bore 58 formed in the upper edge adjacent to the protrusions 54, 55, and in one embodiment the bore 58 may be positioned between the protrusions. The interior of the bore 58 may be threaded for accepting the end of a threaded fastener. The bore 58 of the fin member 52 is alignable with one or more of the securing holes 48 of the fin box 34, so that a fastener 50 may be extended through the securing hole and into the bore 58 for providing securing of the fin member 52 to the fin box 34 at a fixed position on the slot 40 of the fin box.

The invention also contemplates a positioning member 60 that is mounted and movable in the slot 40 for occupying or filling portions of the slot not occupied by the protrusions 54, 55 of the fin member 52. In the most preferred embodiments of the invention, a plurality of positioning members 60, 61, 62, 63 for occupying portions of the slot 40 when the fin member 52 is located at different positions in the slot (see FIG. 8). The plurality of positioning members 60 through 63 may be inserted into the slot 40 through the loading/unloading portion of the slot. A portion of the slot 40 is preferably left free of the positioning members so that the positioning members 60–63 are longitudinally shiftable in the slot to change and adjust the location of the portion of the slot that is not occupied by any of the positioning members. The space or gap between the positioning members in the slot 40 is arranged so that it is locate above the desired position of the fin member 52 with respect to the fin box 34.

For ease and clarity of description, positioning member 60 will be described in detail with the understanding that the other positioning members 61 through 63 may be substantially identical, with the length possibly being varied from one member with respect to the other members.

The positioning member 60 may comprise a base portion 64, and may also include a filler portion 66 (see FIG. 8). The base portion 64 of the positioning member 60 is removably positionable in the slot 40, and may be slidably movable in the retaining portion 44 of the slot. The base portion 64 of the positioning member 60 may have a width that is greater than the width of the entry portion 42 of the slot 40 so that the base portion cannot move through the entry portion, and the base portion 64 may be moved into retaining portion 44 of the slot 40 through the loading/unloading opening 46. The filler portion 66 may be removably positionable in the slot 40, and may be slidably moveable in the entry portion 42 of the slot when the base portion 64 is located in the retaining portion 44 of the slot.

The invention also contemplates a closing member 70 (see FIG. 3) that is removably positionable in the loading/unloading opening 46 in the fin box 34 for selectively preventing movement of the fin member 52 and the positioning member 60 out of the slot 40 when the closing member 70 is positioned in the opening 46. The closing member 70 suitably has a size and shape that is similar to the dimensions of the loading/unloading opening 46 so that the closing member may fit snugly therein. It will be realized that the loading/unloading opening 46 should have a dimension sufficiently large to be able to receive the base portion of the positioning members. The closing member 70 may include a bore 72 formed therein that is alignable with one of the securing holes 48 of the fin box 34, so that a fastener 50 may be extended through the securing hole and into the bore 72 for holding the closing member in the opening 46.

In use, the fin box 34 is positioned in the cavity 26 of the board 12, and another fin box may be positioned in a second cavity 27 of the board 12. With the closing member 70 removed from the loading/unloading opening 46, the user may insert a number of the positioning members 60–63 into the slot 40, while leaving a space in the slot not occupied by one of the positioning members. The positioning members are slid longitudinally in the slot until a space between the positioning members is formed at the location where the fin member 52 is desired to be located for board use. Once the gap or space is positioned where the fin member 52 is desired to be located, the fin member 52 is positioned over the slot 40 so that the protrusions 54, 55 of the fin member extend into the space in the slot formed between the positioning members. A fastener is passed through one of the securing holes 48 that is located over the space and the threaded end of the fastener is inserted into the bore 58 of the fin member 52. The positioning members located adjacent to the space prevent the movement of the protrusions (and thus the fin member) in a longitudinal direction of the slot.

In an optional embodiment of the invention, a fin box 76 (see FIG. 6) has a contoured lower surface that preferably follows the contour of the lower surface of the board.

In another optional embodiment of the invention, a fin box 74 (see FIG. 7) is removably mountable in the board 12. Once removed from the board 12, an end wall 76 is removable from the remainder of the fin box 74 to expose an end of the slot so that the fin member and the positioning members may be removed from and inserted into the slot (see FIG. 8). The arrangement of the positioning members 60 through 62 and the fin member 52 depicted in FIG. 8 is similar to the arrangements possible in the other configurations of the fin box described herein.

Illustratively, many of the component parts of the invention may be formed from a lightweight material, such as a plastic material. Significantly, as the positioning members define an open space in the slot not occupied by the positioning members, and the fin member is thus held in place in the slot by the fastener 50 and is blocked from movement along the slot until the protrusions are first withdrawn from the slot, and then the positioning members may be shifted in the slot in order to reposition the space and thus reposition the fin member when it is remounted on the fin box.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable fin insert assembly for mounting on a cavity of a wake board, the adjustable fin insert assembly comprising:

a fin box positionable in the cavity of the board, the fin box having an upper surface and a lower surface, the fin box being elongate with a front end and a rear end, the fin box including a slot formed in the fin box, the slot extending into the fin box from the lower surface thereof, the slot extending along a longitudinal extent of the fin box;

a fin member removably mountable on the fin box adjacent the slot, a portion of the fin member extending into and being slidable along the slot for permitting adjustment of a position of the fin member in the slot; and a plurality of positioning members positionable in the slot forwardly or rearwardly of the portion of the fin member extending into the slot to adjust the position of the portion of the fin member in the slot, the positioning members being longitudinally slidable in the slot, a space being defined in the slot adjacent to at least one of the positioning members, the space being repositionable in the slot by sliding the at least one of the positioning members.

2. The assembly of claim 1 wherein the slot in the fin box comprises:

an entry portion in communication with the lower surface of the fin box; and a retaining portion in communication with the entry portion of the slot.

3. The assembly of claim 2 wherein the entry portion extends in a plane oriented substantially perpendicular to the lower surface of the fin box and the retaining portion extends in a plane oriented substantially perpendicular to the plane of the entry portion.

4. The assembly of claim 1 additionally comprising a loading/unloading opening formed in the fin box and being in communication with the slot to permit loading and unloading of the fin member and the positioning member in the slot.

5. The assembly of claim 1 additionally comprising at least one protrusion extending from the fin member for being removably insertable in the slot when the fin member is positioned adjacent the slot.

6. The assembly of claim 5 wherein a pair of spaced said protrusions extend from the fin member for inserting into the slot.

7. An adjustable fin insert assembly for mounting on a cavity of a wake board, the adjustable fin insert assembly comprising:

a fin box positionable in the cavity of the board, the fin box having an upper surface and a lower surface, the fin box being elongate with a front end and a rear end, the fin box including a slot formed in the fin box, the slot extending into the fin box from the lower surface thereof, the slot extending along a longitudinal extent of the fin box;

a fin member removably mountable on the fin box adjacent the slot, a portion of the fin member extending into and being slidable along the slot for permitting adjustment of a position of the fin member in the slot; and a plurality of positioning members positioned in the slot and being longitudinally slidable in the slot, a space being defined in the slot adjacent to at least one of the positioning members, the space being repositionable in the slot by sliding the at least one of the positioning members;

wherein the positioning member comprises:

a base portion being removably positionable in the slot;

a filler portion being removably positionable in the slot.

8. The assembly of claim 7 wherein the base portion of the positioning member is slidably movable in a retaining portion of the slot and the filler portion is slidably moveable in an entry portion of the slot when the base portion is located in the retaining portion of the slot.

9. The assembly of claim 4 additionally comprising a closing member removably positionable in the loading/unloading opening in the fin box for selectively preventing movement of the fin member and the positioning member out of the slot.

10. The assembly of claim 1 wherein the plurality of positioning members are removably positionable in the slot.

11. An adjustable fin insert assembly for mounting on a cavity of a wake board, the adjustable fin insert assembly comprising:

a fin box positionable in the cavity of the board, the fin box having an upper surface and a lower surface, the fin box being elongate with a front end and a rear end, the fin box including a slot formed in the fin box, the slot extending into the fin box from the lower surface thereof, the slot extending along a longitudinal extent of the fin box;

a fin member removably mountable on the fin box adjacent the slot, a portion of the fin member extending into and being slidable along the slot for permitting adjustment of a position of the fin member in the slot; and a plurality of positioning members positioned in the slot and being longitudinally slidable in the slot, a space being defined in the slot adjacent to at least one of the positioning members, the space being repositionable in the slot by sliding the at least one of the positioning members; and a plurality of securing holes formed in the fin box, each of the securing holes extending into the fin box from the upper surface thereof.

12. The assembly of claim 11 wherein a bore is formed in the fin member, the bore in the fin member being alignable with one of the securing holes in the fin box such that a fastener is extendable through one of the securing holes, the space adjacent to the at least one positioning member, and into the bore of the fin member.

13. The assembly of claim 11 wherein the plurality of securing holes is in communication with the slot.

14. The assembly of claim 13 wherein the plurality of securing holes is distributed along a length of the slot.

15. The assembly of claim 1 wherein the slot in the fin box comprises an entry portion in communication with the lower surface of the fin box and a retaining portion in communication with the entry portion of the slot;

wherein the entry portion extends in a plane oriented substantially perpendicular to the lower surface of the fin box and the retaining portion extends in a plane oriented substantially perpendicular to the plane of the entry portion;

a loading/unloading opening formed in the fin box and being in communication with the slot to permit loading and unloading of the fin member and the positioning member in the slot;

at least one protrusion extending from the fin member for being removably insertable in the slot when the fin member is positioned adjacent the slot;

wherein a pair of spaced said protrusions extend from the fin member for inserting into the slot;

wherein the positioning member comprises a base portion being removably positionable in the slot and a filler portion being removably positionable in the slot;

wherein the base portion of the positioning member is slidably movable in the retaining portion of the slot and the filler portion is slidably moveable in the entry portion of the slot when the base portion is located in the retaining portion of the slot;

a closing member removably positionable in the loading/unloading opening in the fin box for selectively preventing movement of the fin member and the positioning member out of the slot;

wherein the plurality of the positioning members are removably positionable in the slot;

a plurality of securing holes formed in the fin box, each of the securing holes extending into the fin box from the upper surface thereof;

wherein a bore is formed in the fin member, the bore in the fin member being alignable with one of the securing holes in the fin box such that a fastener is extendable through one of the securing holes, the space adjacent to the at least one positioning member, and into the bore of the fin member;

wherein the plurality of securing holes is in communication with the slot; and wherein the plurality of securing holes is distributed along a length of the slot.

16. A wake board system comprising:

a wake board having a front portion and a rear portion and a longitudinal axis extending between the front and rear portions of the board, the board having an upper surface and a lower surface, the board having a pair of lateral side edges and rear edge, the board having a cavity formed therein; and an adjustable fin insert assembly mounted in the cavity of the wake board, the adjustable fin insert assembly comprising:

a fin box positionable in the cavity of the board, the fin box having an upper surface and a lower surface, the fin box being elongate with a front end and a rear end, the fin box including a slot formed in the fin box, the slot extending into the fin box from the lower surface thereof, the slot extending along a longitudinal extent of the fin box;

a fin member removably mountable on the fin box adjacent the slot, a portion of the fin member extending into and being slidable along the slot for permitting adjustment of a position of the fin member in the slot; and a plurality of positioning members positionable in the slot forwardly or rearwardly of the portion of the fin member extending into the slot to adjust the position of the portion of the fin member in the slot, the positioning members being longitudinally slidable in the slot, a space being defined in the slot adjacent to at least one of the positioning members, the space being repositionable in the slot by sliding the at least one of the positioning members.

17. The system of claim 16 wherein a pair of the cavities are formed in the board, the pair of cavities being laterally spaced on the board, and wherein a pair of the adjustable fin insert assemblies are mounted in the pair of cavities.

18. The assembly of claim 1 wherein the positioning members are configured to close the slot forwardly or rearwardly of the fin member.

19. The assembly of claim 16 wherein the positioning members are configured to close the slot forwardly or rearwardly of the fin member.

20. An adjustable fin insert assembly for mounting on a cavity of a wake board, the adjustable fin insert assembly comprising:

a fin box positionable in the cavity of the board, the fin box having an upper surface and a lower surface, the fin box being elongate with a front end and a rear end, the fin box including a slot formed in the fin box, the slot extending into the fin box from the lower surface thereof, the slot extending along a longitudinal extent of the fin box;

a fin member removably mountable on the fin box adjacent the slot, a portion of the fin member extending into and being slidable along the slot for permitting adjustment of a position of the fin member in the slot; and a plurality of positioning members positionable in the slot and forwardly or rearwardly of the portion of the fin member extending into the slot to adjust the position of the portion of the fin member in the slot;

wherein the positioning members are configured to close the slot forwardly or rearwardly of the fin member substantially flush with the lower surface of the fin box.

* * * * *